United States Patent [19]

Brisson et al.

[11] Patent Number: 4,700,165

[45] Date of Patent: Oct. 13, 1987

[54] DC ELECTROMAGNET EQUIPPED WITH A VOLTAGE SURGE DAMPING DEVICE

[75] Inventors: Alain Brisson; Jean-René Clément, both of Poitiers, France

[73] Assignee: La Telemecanique Electrique

[21] Appl. No.: 748,387

[22] Filed: Jun. 25, 1985

[30] Foreign Application Priority Data

Jun. 25, 1984 [FR] France ..... 84 09964

[51] Int. Cl.[4] ..... H01F 7/10

[52] U.S. Cl. ..... 335/255; 335/245

[58] Field of Search ..... 335/243, 244, 245, 247, 335/249

[56] References Cited

U.S. PATENT DOCUMENTS

| | | | |
|---|---|---|---|
| 1,789,417 | 1/1931 | Shepard | 335/247 X |
| 2,944,195 | 7/1960 | Mobarry | 335/245 |
| 4,177,440 | 12/1979 | Merlette | 335/247 |
| 4,262,877 | 4/1981 | Lang | 335/244 X |

*Primary Examiner*—George Harris

*Attorney, Agent, or Firm*—William A. Drucker

[57] ABSTRACT

A voltage surge damping device for electromagnets is provided which applies more particularly to electromagnets of the type comprising a fixed magnetic circuit and a mobile magnetic circuit cooperating with the fixed magnetic circuit and forming therewith, in the "closed" position, at least one air gap. Said device comprises at least one short circuiting ring mounted on the fixed magnetic circuit and formed by a good electrically conducting and a magnetic metal sheet, and having at least one part shaped so as to extend into said air gap.

7 Claims, 6 Drawing Figures

DC ELECTROMAGNET EQUIPPED WITH A VOLTAGE SURGE DAMPING DEVICE

BACKGROUND OF THE INVENTION

1. Field of the Invention

The present invention relates to a voltage surge damping device for DC electromagnets as well as an DC electromagnet equipped with such a device.

It relates more particularly still to a device adapted for fulfilling at least two functions, namely; a function limiting cut-off voltage surges of the DC electromagnet and a function consisting in destroying the remanent induction of the magnetic circuit of the DC electromagnet when the control coil is not supplied with power.

2. Description of the Prior Art

It is generally known that in some types of electromagnets the function of limiting cut-off voltage surges is provided by a short circuit ring made from a copper alloy preferably mounted on the fixed part of the magnetic circuit supporting the coil of the electromagnet.

Moreover, elimination of the remanent induction of the magnetic circuit when the control coil is not supplied with power is obtained by defining air gaps, in the closed condition of the electromagnet, by means of pieces made from an amagnetic material which may also have damping properties.

These two functions are fulfilled for example in the silient electromagnet described in French patent application No. 84 03014 filed on the 28th Feb. 1984, in the name of the applicant for: "Silent Electromagnet and Contactor using such an Electromagnet" which describes an electromagnet comprising:

a fixed magnetic circuit, in the form of an E, in which the end of the central leg has a V shaped concavity in profile and in which the ends of the two side legs have an external chamfered face, a mobile magnetic circuit, also in the form of an E, in which the end of the central leg has a convex shape in profile substantially complementary to that of said cavity and in which the ends of the side legs have an inner chamfered face, and a coil wound about the central legs of the mobile and fixed magnetic circuits.

In this example, the function of limiting the cut off voltage surges is provided by means of a ring made by stamping and bending a metal sheet of small thickness, and mounted on the web of the magnetic circuit.

The air gaps formed in the closed condition of the electromagnet by said concave and convex shapes and by the chamfered faces of the magnetic circuits of the electromagnet are then materialized by molded rings, made for example from silicone coated elastomer, mounted on the two side legs of the fixed magnetic circuit and on which come to bear the ends of the side legs of the mobile magnetic circuit.

However, in this embodiment, these two functions are only correctly fulfilled when centering of the two fixed and mobile magnetic circuits is good and when the guide play of the mobile circuit is small.

In fact, because the lateral or central oblique air gaps must be small, by definition, so as to reduce the air gap reluctances in open circuit, appreciable off-centering and/or too large a guide play cause, during closure, dissymmetry of the lateral air gaps which may lead to magnetic "sticking" on one of the side legs, which may lead to total non closure of the magnetic circuit.

To avoid this drawback, it is then necessary to place on these two faces a piece of amagnetic material, preferably with an antifriction property, which will be limited to a guide function, when closure is beginning and will not provide the function of defining the final air gap (antiremanent air gap) since this function remains provided by the previously mentioned elastomer rings.

It is clear that these arrangements use a multiplicity of parts (voltage surge limiting ring, elastomer rings, antifriction amagnetic material piece).

The purpose of the invention is therefore more particularly to overcome this drawback.

SUMMARY OF THE INVENTION

For this it provides a voltage surge damping device in which the two above mentioned functions may be performed by one and the same piece.

Thus, in a DC electromagnet comprising a fixed magnetic circuit and a mobile magnetic circuit cooperating with the fixed magnetic circuit and forming therewith, in the "closed" position, at least one air gap, the voltage surge damping device of the invention comprises a short circuiting ring mounted on the magnetic circuit so as to damp the voltage surges due to variations of the magnetic flux during operation of the electromagnet, this ring being formed by a good electrically conducting and amagnetic metal sheet comprising at least one part formed so as to extend into said air gap.

It is clear that in the absence of particular means provided for materializing the air gaps formed in the closed state of the electromagnet, the legs of the short circuiting ring fulfill this function as well as that of guiding.

On the other hand, in the case where the electromagnet is of the type described in the above mentioned patent application, the two legs of the short circuiting ring will only serve for participating in guiding at the beginning of closure and will have no function of defining a final air gap (antiremanent air gap) since this function remains provided by elastomer rings.

It should be noted that in this connection that this second solution, which is more complex, is only justified when it is desired to obtain a silent electromagnet and when, in this case, the antiremanent elements further play the role of damper.

Furthermore, in the case of DC fed electromagnets operating in a normally noisy environment, the first solution in which the voltage surge limiting ring provides at the same time air gap centering guidance on closure and antiremanence, is more advantageous.

BRIEF DESCRIPTION OF THE DRAWINGS

Embodiments of the invention will be described hereafter by way of non limitative examples, with reference to the accompanying drawings in which.

DESCRIPTION OF THE PREFERRED EMBODIMENTS

Figure 1:
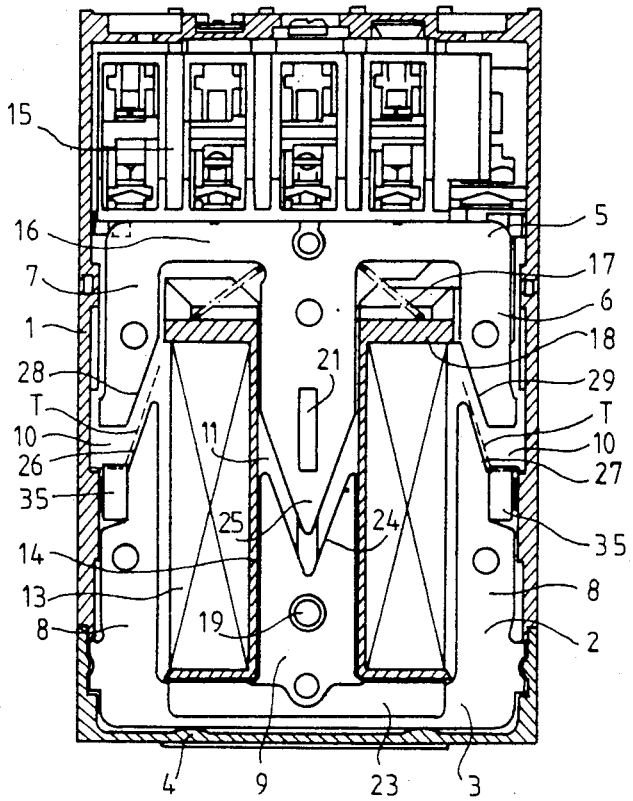
FIG. 1 is a sectional view of a contactor of the type described in the French patent application No. 84 03014.

With reference to FIG. 1, the contactor has a conventional translation contactor structure comprising, inside a case 1:

a fixed magnetic circuit 2, in the form of an E, whose web 3 is fixed against a bottom plate 4 integral with case 1, a mobile magnetic circuit 5, also in the shape of an E, whose legs 6, 7 are respectively aligned with legs 8, 9 of the fixed magnetic circuit 2, the respective ends of legs 6, 7, 8, 9 of these two magnetic circuits being mutually facing each other and forming air gaps 10, 11, a coil 13 wound on a tubular carcase 14 and disposed in the volume between legs 6, 7, 8, 9 of the fixed magnetic circuit 2 and of the mobile magnetic circuit 5, fixing means for securing carcase 14 of coil 13 to the fixed magnetic circuit 2, means for guiding the mobile magnetic circuit 5 in said carcase 14, a mobile contact holding assembly 15 mounted on the web 16 of the mobile magnetic circuit 5, and at least one return spring 17 disposed between the upper shoulder 18 of carcase 14 of coil 13 and the web 16 of the magnetic circuit 5.

More precisely, in the example shown, the fixed magnetic circuit 2 is secured and centered in coil 13 by means of a cylindrical pin 19. Of course, the invention is not limited to such an arrangement. The fixed magnetic circuit 2, could, for example, be quite simply force fitted in the carcase 14 of coil 13.

For guiding it, the mobile magnetic circuit 5, comprises a key 21 cooperating with an axial groove provided in the carcase 14 of coil 13.

The shapes of air gaps 10 and 11 are determined at the design stage so as to adapt the law of variation of the drive force to the resistant force.

Thus, in this example, the end of the central leg 9 of the fixed magnetic circuit has a concave shape in profile, in the shape of a V,24, in which is engaged the end 25 of the central leg 7 of the mobile magnetic circuit 5 which has, consequently, a substantially complementary convex shape in the form of a V. These two complementary shapes 24, 25 define substantially V-shaped air-gap 11.

Similarly, the ends of the two side legs 8 of the fixed magnetic circuit 2 each comprise an outer chamfered face 26, 27 and the ends of the two lateral legs 6 of the mobile magnetic circuit 5 each comprise an inner chamfered face 28, 29, the outer chamfered faces 26, 27 of the fixed magnetic circuit 2 cooperating with the inner chamfered faces 28, 29 of the mobile magnetic circuit 5 so as to form two lateral air gaps 10 oblique with respect to each other.

Such shapes of air gaps 10, 11 have the advantage of being easily reproducible for industrial mass production, by adopting a technique of stamping thin metal sheets assembled together by methods which are henceforth conventional (rivetting) so as to obtain AC fed magnetic circuits.

The obliqueness of the active lateral 10 and central 11 air gaps, with respect to the translational closure movement of the mobile magnetic circuit 5, reduces the pull reluctances for the same useful stroke.

In this embodiment, the voltage surge limiting function is obtained by means of a metal sheet made from copper alloy bent so as to have a cross section in the shape of a U whose web comprises a substantially rectangular central recess. This metal sheet is disposed on web 3 of the fixed magnetic circuit 2 which it partially envelops, the central leg 9 passing through the recess. It provides the short circuiting ring function for damping voltage surges at cut-off by consuming energy during flux variations in the central leg 9 of the magnetic circuit.

The antiremanence and damping function is obtained by means of two dampers 35 each formed from a ring with rectangular cross section made from silicone coated elastomer, obtained by molding. They fit onto two respective studs 45 provided on the outer faces of the side legs 8 of the fixed magnetic circuit 2, substantially at the base of the chamfered faces 26, 27.

These studs 45 are obtained by stamping magnetic metal sheets at an appropriate angle 46 for facilitating assembly of the rings forming dampers 35.

The position of these dampers 35 on which the end of leg 6 of the mobile magnetic circuit 5 abuts fulfills, in addition to the damping role, the antiremanence function of air gaps 10, 11 materialized by the amagnetic elastomer. The choice of a silicone coated elastomer results from the requirements of resistance of the antiremanent damper to the working temperatures of the electromagnet, to the cutting oils used for the metal sheets and high mechanical endurance. In addition, the qualities of non adherence (sticking) of such an elastomer are useful for guaranteeing in time the unsticking of the mobile circuit when the power supply to the electromagnet is cut off. It is obvious that any amagnetic material having mechanical damping properties and suitable for the endurance requirements and for the environmental conditions may be used within the scope of the invention.

It will be noted that, in FIG. 1, the broken lines T indicating the closed position of the mobile magnetic circuit show that, in this position, the dampers 35 are crushed but leave lateral and central air gaps not materialized.

Figure 2:
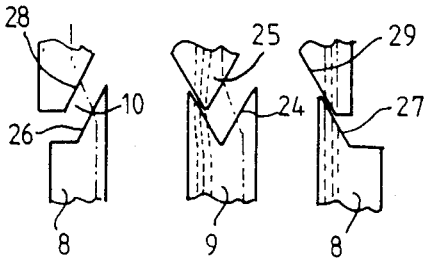
FIG. 2 is a schematical view of the ends of the legs of the mobile and fixed parts of the magnetic circuit of the contactor shown in FIG. 1, in the case of magnetic sticking.

As mentioned above, when the mobile magnetic circuit is off/centered, magnetic sticking occurs of the type illustrated in FIG. 2. The same occurs when the guiding of the mobile magnetic circuit 5 has considerable play which allows the mobile magnetic circuit 5 to skew and causes consequently a parallelism defect of air gaps 10, 11.

Figure 3:
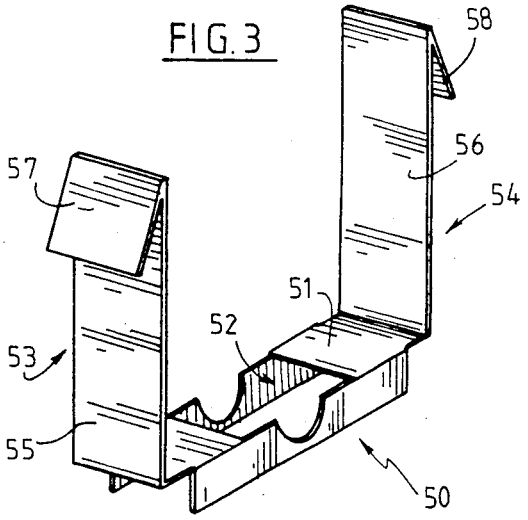
FIG. 3 is a perspective view of a voltage surge damping device according to the invention, usable in the contactor shown in FIG. 1.
Figure 4:
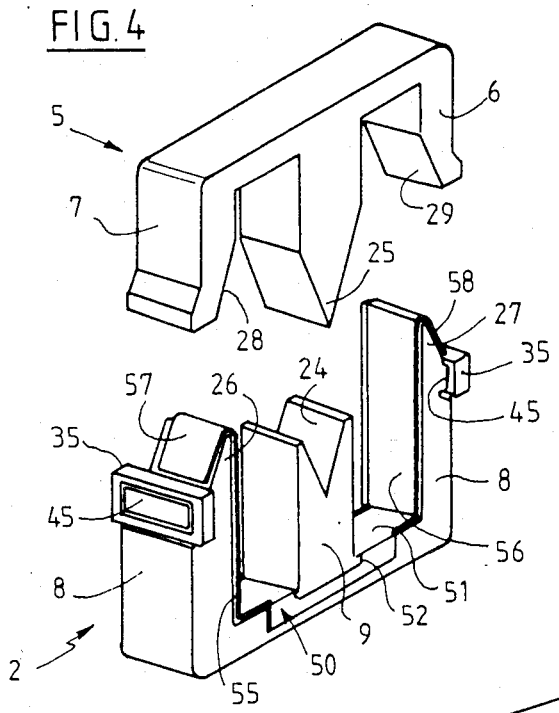
FIG. 4 is a perspective view of the fixed and mobile parts of the magnetic circuit of the contactor shown in FIG. 1, equipped with the voltage surge damping device shown in FIG. 3.
Figure 5:
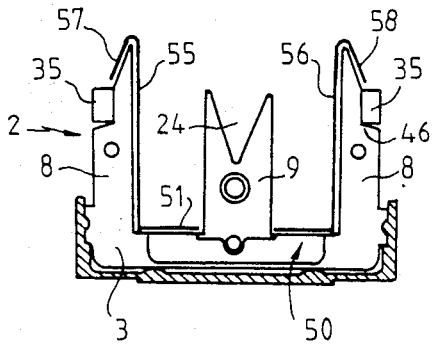
FIG. 5 is a side view of the fixed part of this magnetic circuit equipped with the voltage surge damping device.

FIG. 3 shows a voltage surge damping ring 50 in accordance with the invention which avoids this sticking problem.

This ring comprises more particularly a body similar to the ring used in FIG. 1 and which has consequently in cross section the shape of a U whose web 51 comprises a central substantially rectangular recess 52, through which the central leg 9 of the fixed magnetic circuit 2 may pass. However, in this case, the web 52 is extended, at each of its ends, by a lug 53, 54 having a first part bent at right angles 55, 56 which extends along the inner face of a corresponding side leg 8 of the fixed magnetic circuit 2. This part 55, 56 being itself extended by an obliquely bent part 57, 58 which overlaps the outer chamfered face 26, 27 of the end of said side leg 8.

This ring 50 is made from a sheet of amagnetic material having both high electric conductivity and antifriction properties, so that, besides its voltage surge limiting function, it provides, through the oblique parts 57, 58, guiding of the mobile magnetic circuit 5 without risk of sticking and materializing the air gaps 10 during closure.

In this example, the antiremanence is provided by dampers 35. It is clear that if these dampers were not used, the oblique parts of the ring, on which the chamfered ends 28, 29 of the side legs 6, 7 of the mobile magnetic circuit 5 would then abut at the end of the closure stroke, would then themselves alone provide the antiremanence function.

Figure 6:
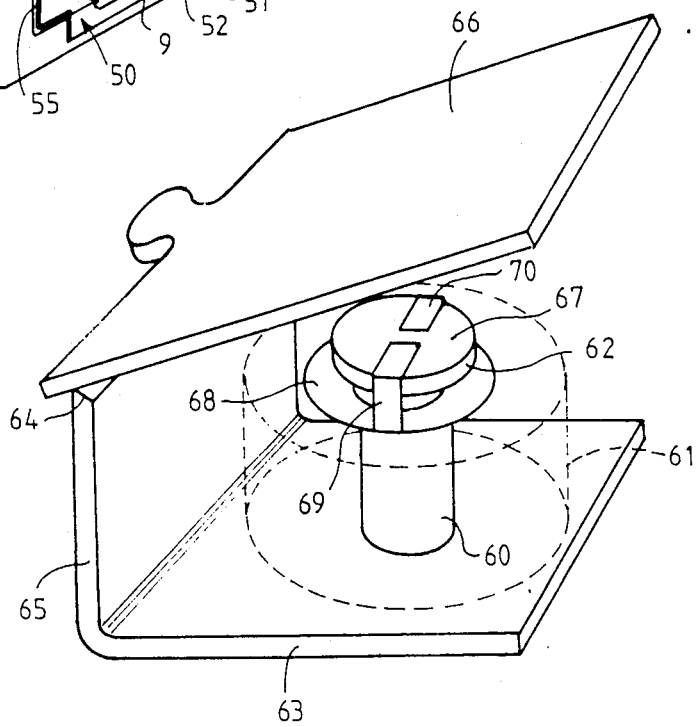
FIG. 6 is a schematical perspective view of an electromagnet in which the voltage surge damping device provides also the antiremanence function.

Of course, the invention is not limited to the form of the above described electromagnet, and the combination of the anti voltage-surge ring and of the antiremanent metal sheet may be applied to any other type of DC electromagnet and, in particular, for forming the voltage surge limiting ring of a mobile palte relay such as the one shown schematically in FIG. 6.

In this Figure, the plate relay is formed from an electromagnet comprising a core 60 about which is fitted a coil 61 shown schematically with broken lines. This core 60 comprises on one side a flat circular head 62 and is fixed at right angles, on the other side, to one of the legs 63 of an L shaped armature. On the upper edge 64 of the other leg 65, which extends parallel to the axis of core 60, is hinged a plate 66 which extends above the head 62 of core 60.

In the closed position, plate 66 which is attracted by this core 60 whose coil 61 is then energized comes to bear and is held against the flat face 67 of head 62 which serves as magnetic bearing surface.

In this case, the voltage surge damping device of the invention consists of a crown shaped ring 68 surrounding core 60 and held under head 62 by means of two legs 69, 70 bent back on the magnetic bearing surface 67 which serve as antiremanent air gaps.

What is claimed is:

1. A voltage surge damping device for DC electromagnets comprising a fixed magnetic circuit and a mobile magnetic circuit cooperating with the fixed magnetic circuit and forming therewith, in the "closed" position, at least one air gap, which device further comprises at least one short circuiting ring which surrounds a portion of the fixed magnetic circuit so as to damp the voltage surges due to variations of the magnetic flux during operation of the electromagnet, said ring being formed by a good electrically conducting and amagnetic metal sheet and comprising at least one part which extends into said air gap, so as to maintain said fixed magnetic circuit and said mobile magnetic circuit separated from each other in said closed position.

2. A voltage surge damping device for DC electromagnets comprising a fixed magnetic circuit and a mobile magnetic circuit cooperating with the fixed magnetic circuit and forming therewith in the "closed" position, at least one air gap, which device further comprises at least one short circuiting ring which surrounds a portion of the fixed magnetic circuit so as to damp the voltage surges due to variations of the magnetic flux during operation of the electromagnet, said ring being formed by a good electrically conducting and amagnetic metal sheet and comprising at least one part shaped so as to extend into said air gap, wherein the fixed magnetic circuit of the electromagnet has an E shape comprising a web, a central leg and two side legs, the ends of said legs forming with said mobile magnetic circuit, in the closed position of this latter, a central air gap and two lateral air gaps and wherein said ring is formed from a metal sheet bent so as to have in cross section the form of a U whose web comprises a recess, said ring being disposed on the web of the fixed magnetic circuit which it envelops partially, the central leg of said fixed magnetic circuit passing through said recess, wherein the web of said ring is extended, at each of its ends, by a lug having a first part bent at right angles which extends against the inner face of the corresponding side leg of the fixed magnetic circuit and the second part extending the first one and bent so as to overlap at least partially the end of said leg so as to materialize the corresponding lateral air gap.

3. The device as claimed in claim 2, wherein said metal sheet has antifriction properties.

4. The device as claimed in claim 2, wherein, in the closed state of the electromagnet, said air gap is defined by damping means disposed between the fixed magnetic circuit and said mobile magnetic circuit.

5. The device as claimed in claim 2, wherein, in the closed state of the electromagnet, said air gap is defined and at least partly materialized by said part of said metal sheet.

6. The device as claimed in claim 5, wherein the ends of the two side legs of the magnetic circuit each comprise a chamfered outer face, and the two ends of the two side legs of said mobile magnetic circuit each comprise a chamfered inner face, the outer chamfered faces of said fixed magnetic circuit cooperating with the inner chamfered faces of said mobile magnetic circuit so as to form two oblique lateral air gaps, and the second parts of the lugs of said ring are bent obliquely so as to overlap at least partially the outer chamfered faces of the respective ends of the side legs of said fixed magnetic circuit.

7. A voltage surge damping device for DC electromagnets comprising a fixed magnetic circuit and a mobile magnetic circuit cooperating with the fixed magnetic circuit and forming therewith, in the "closed" position, at least one air gap, which device further comprises at least one short circuiting ring which surrounds a portion of the fixed magnetic circuit so as to damp the voltage surges due to variations of the magnetic flux during operation of the electromagnet, said ring being formed by a good electrically conducting and amagnetic metal sheet and comprising at least one part shaped so as to extend into said air gap, wherein the electromagnet comprises a core about which the coil is fitted and having a head with a flat magnetic bearing surface, and a mobile plate which, in the energized position of the electromagnet, is attracted against said magnetic bearing surface, wherein said voltage surge damping surface consists of a crown shaped ring surrounding said core and held in position under said head by means of at least one leg bent back on said magnetic bearing surface and serving as antiremanent air gap.

* * * * *